US010576999B2

(12) United States Patent
Fenayon et al.

(10) Patent No.: US 10,576,999 B2
(45) Date of Patent: Mar. 3, 2020

(54) RAILCAR ADAPTER FOR CONNECTING A RAILCAR BODY TO A BEARING

(71) Applicant: Aktiebolaget SKF, Gothenburg (SE)

(72) Inventors: Ludovic Fenayon, Montbazon (FR); Thierry Le Moigne, Luynes (FR)

(73) Assignee: AKTIEBOLAGET SKF, Gothenburg (SE)

( * ) Notice: Subject to any disclaimer, the term of this patent is extended or adjusted under 35 U.S.C. 154(b) by 599 days.

(21) Appl. No.: 15/341,424

(22) Filed: Nov. 2, 2016

(65) Prior Publication Data

US 2017/0137041 A1 May 18, 2017

(30) Foreign Application Priority Data

Nov. 13, 2015 (EP) ..... 15306799

(51) Int. Cl.

| | |
|---|---|
| ***B61F 15/20*** | (2006.01) |
| ***B61F 15/26*** | (2006.01) |
| ***B61F 15/12*** | (2006.01) |
| ***B61F 15/02*** | (2006.01) |

(52) U.S. Cl.

CPC ..... *B61F 15/20* (2013.01); *B61F 15/02* (2013.01); *B61F 15/12* (2013.01); *B61F 15/26* (2013.01)

(58) Field of Classification Search

CPC ..... B61F 15/12; B61F 15/02; B61F 15/20; B61F 15/26

See application file for complete search history.

(56) References Cited

U.S. PATENT DOCUMENTS

| | | | |
|---|---|---|---|
| 1,841,077 | A | 1/1932 | Anderson |
| 4,428,303 | A | 1/1984 | Tack |
| 5,150,658 | A | 9/1992 | Grandy |
| 5,503,084 | A | 4/1996 | Goding et al. |
| 5,794,538 | A | 8/1998 | Pitchford |
| 5,799,582 | A | 9/1998 | Rudibaugh et al. |
| 6,142,081 | A | 11/2000 | Long et al. |
| 7,966,946 | B1 | 1/2011 | Novak et al. |
| 2014/0318412 | A1 | 10/2014 | East et al. |
| 2015/0183442 | A1 | 7/2015 | Gotlund et al. |

FOREIGN PATENT DOCUMENTS

| | | | | |
|---|---|---|---|---|
| CN | 1942355 | A | 4/2007 | |
| CN | 104044604 | A | 9/2014 | |
| CN | 104822575 | A | 8/2015 | |
| EP | 0825084 | A2 | 2/1998 | |
| WO | 2005005219 | A2 | 1/2005 | |
| WO | WO-2005005219 | A2 * | 1/2005 | ..... B61F 5/122 |
| WO | WO-2014131117 | A1 * | 9/2014 | ..... B61F 5/06 |

* cited by examiner

*Primary Examiner* — Scott A Browne

(74) *Attorney, Agent, or Firm* — Garcia-Zamor Intellectual Property Law, LLC; Ruy Garcia-Zamor; Bryan Peckjian

(57) ABSTRACT

Railcar adapter for connecting a railcar body to a bearing providing an adapter body having two lateral channels each axially delimited by a pair of opposed lugs and a lateral surface perpendicular to the opposed lugs, each lateral channel being adapted to cooperate with the railcar body. The railcar adapter further provides swivelling means allowing swivelling of the railcar adapter relative to the railcar body.

13 Claims, 3 Drawing Sheets

RAILCAR ADAPTER FOR CONNECTING A RAILCAR BODY TO A BEARING

CROSS-REFERENCE TO RELATED APPLICATIONS

This application claims priority to European patent application no. 15306799 filed on Nov. 13, 2015, the contents of which are fully incorporated herein by reference.

FIELD OF THE INVENTION

The present invention relates to the field of bearing adapters for a railcar.

BACKGROUND OF THE INVENTION

A railcar generally provides a pair of side frames on each side having downwardly opening jaws. A bearing adapter is vertically moveable within the jaw and rests on a bearing mounted on a railcar axle carrying a wheel of the railcar. Typically, a bearing for a railcar axle fits around a journal at the end of the railcar axle where it is mounted between a backing ring assembly and an end cap.

The railcar adapter acts as a rigid connection between the bogie frame and the railcar axle. There is thus no possible movement between the railcar adapter and the bogie frame in case of relative movement between the bogie frame and the railcar axle. The guiding surfaces of the railcar adapter are thus rapidly deteriorated. Indeed, the twisting of the bogie frame generates high efforts on the guiding surface of the adapter and on the bearing.

Therefore, it is an object of the invention to reduce the efforts transmitted from the bogie frame to the adapter.

A solution to reduce those efforts is to harden the adapter. However, such solution is not satisfactory since it is expensive and has an impact on dimension and tolerances of the bearing seat and on the guiding areas of the adapter.

BRIEF SUMMARY OF THE INVENTION

In one embodiment, a railcar adapter, for radially connecting a railcar body to a bearing, comprises an adapter body having two lateral channels each axially delimited by a pair of opposed lugs and a lateral surface perpendicular to the opposed lugs. Each lateral channel is adapted to cooperate with the railcar body.

The railcar adapter provides swivelling means allowing swivelling of the railcar adapter relative to the railcar body.

In one embodiment, the swivelling means provide at least one first lateral centering bump provided on each lateral surface between two opposite lugs.

Such centering bump improves the service life of the railcar adapter by allowing swivelling of the railcar adapter relative to the bogie frame. The first lateral centering bump may be located on the whole axial length of the corresponding lateral surface or on a part of the lateral surface. As an alternative, the swivelling means may provide a plurality of first lateral centring bumps on the whole axial length of the corresponding lateral surface or on a part of the lateral surface.

In another embodiment, the swivelling means provide at least one second and third lateral centering bumps provided on each inner lateral surface of the two opposite lugs. The second and third lateral centering bump may be located on the whole length of the corresponding inner lateral surface or on a part of the inner lateral surface. As an alternative, the swivelling means may provide a plurality of second and third lateral centring bumps on the whole length of the corresponding inner lateral surface or on a part of the inner lateral surface.

The contact surface of the swivelling means with the railcar body is, for example, a flat surface. As an alternative, the contact surface of the swivelling means with the railcar body may be a cylindrical surface or a spheroidal surface.

In one embodiment, the swivelling means are part of the adapter.

In another embodiment, the swivelling means are distinct from the adapter. The swivelling means may thus be made in any material different from the material of the adapter.

Advantageously, the railcar adapter is made from steel or cast iron.

According to another aspect, the invention relates to a railcar adapter assembly comprising a railcar adapter as described above, a bearing mounted inside the railcar adapter, a backing ring adapted to come into axial contact with the bearing at a first side, and an end cap assembly adapted to come into axial contact with the bearing at another side, opposite to the first side.

In one embodiment, the bearing provides at least one inner ring and at least one outer ring mounted in radial contact with the inner surface of the railcar adapter.

In one embodiment, the bearing provides at least one row of rolling elements, arranged between raceways provided on the inner and outer rings.

In one embodiment, the inner ring of the bearing is made in two parts, axially separated by an axial spacer.

According to another aspect, the invention relates to railcar axle comprising a railcar adapter assembly as described above, a shaft being rotatably mounted about an axis of rotation relative to a railcar adapter, inside the bearing. The shaft provides a first end mounted radially inside the backing ring and a second end, opposite to the first end, secured to the end cap assembly.

BRIEF DESCRIPTION OF THE SEVERAL VIEWS OF THE DRAWING

Other advantages and features of the invention will emerge upon examining the detailed description of embodiments, which are in no way limiting, and the appended drawings wherein.

DETAILED DESCRIPTION OF THE INVENTION

Figure 1:
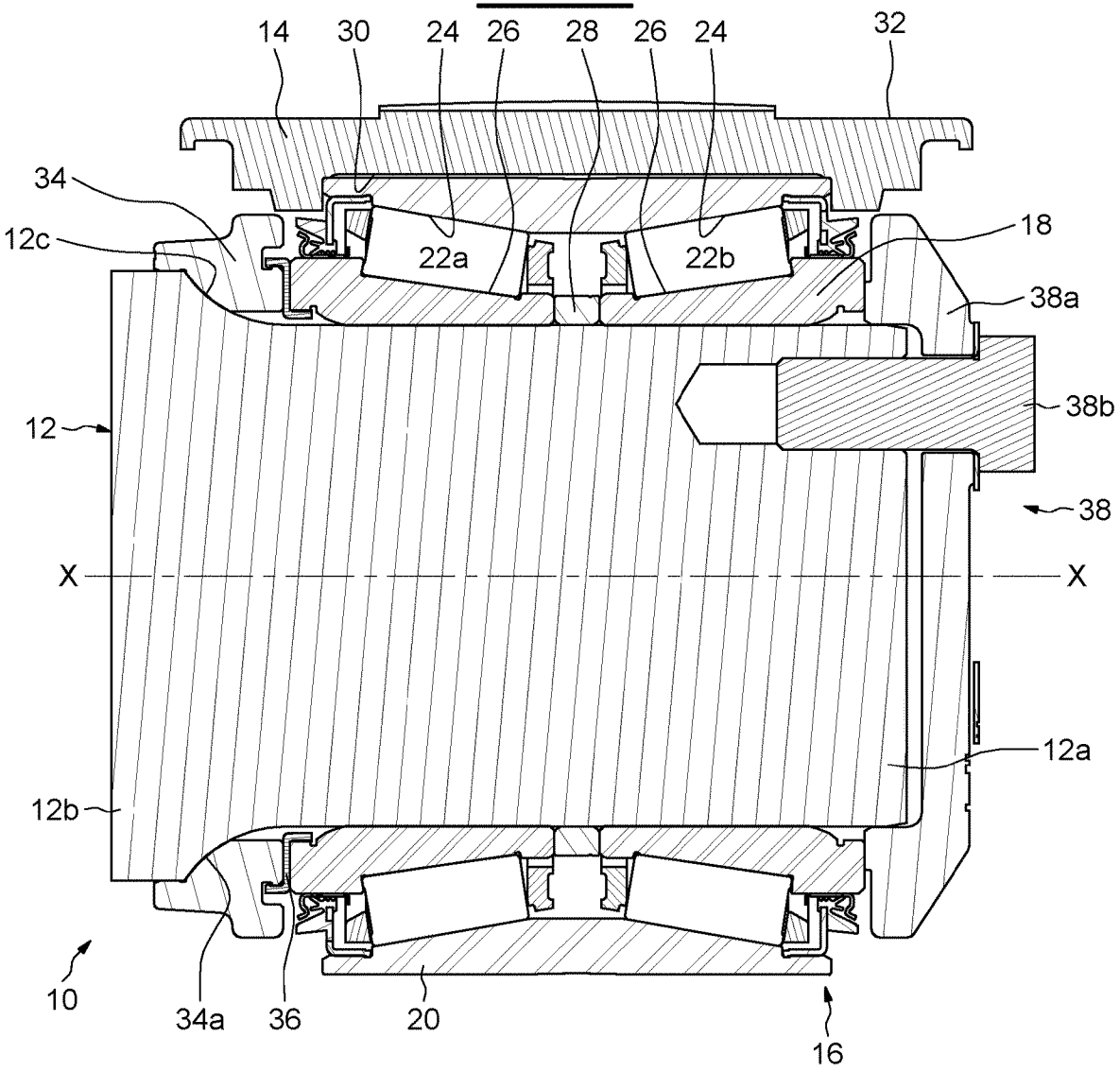
FIG. 1 is an axial cross-section of a railcar axle according to the invention.

Referring to FIG. 1, a railcar axle 10 is provided for binding the bogie frame of a railcar to the wheels (not shown). The railcar axle 10 provides a shaft 12, being rotatably mounted about an axis of rotation X-X relative to a railcar adapter 14. The railcar adapter 14 is secured to the railcar bogie frame, the shaft 12 being secured to the wheels.

A bearing 16 is radially provided between the railcar adapter 14 and the shaft 12. As illustrated, the bearing 16 is of the rolling bearing type, and provides an inner ring 18 mounted on the shaft 12, an outer ring 20 mounted inside the railcar adapter 14 and two rows of rolling elements 22*a*, 22*b*, for example rollers, arranged between raceways 24, 26 provided on the inner and outer rings 18, 20. The inner ring 18 is, for example, made in two parts, axially separated by an axial spacer 28. In this embodiment, the bearing 16 is a tapered rollers bearing.

The railcar adapter 14 is secured to the outer ring 20 by its radially inward side or bearing seat side 30 and is mounted inside the bogie frame by its radially outward side or frame seat side 32.

The shaft 12 provides a journal 12*a* and a dust guard having a cylindrical surface 12*b* whose diameter is bigger than the diameter of the journal 12*a*. A concave fillet 12*c* connects the cylindrical surface 12*b* on the journal 12*a*. The inner ring 18 of the bearing is mounted on the journal 12*a*.

As illustrated on FIG. 1, the railcar axle 10 further provides a backing ring 34 having an inner surface 34*a* adapted to radially come into contact with the outer surface of the shaft 12, at the fillet 12*c* side and to axially come into contact with the inner ring 18 of the bearing 16, through a sealing means 36. Accordingly, the inner surface 34*a* has a rounded shape, almost complementary to that of the fillet 12*c*.

The railcar axle 10 also provides an end cap assembly 38. The end cap assembly 38 includes an end cap 38*a* provided for being a stop element in case of a leftward translation (relative to FIG. 1) of the shaft 12 relative to the inner ring 18. Therefore, the end cap 38*a* is reliably secured to the journal 12 by means of three cap screws 38*b* and comes in axial contact with the inner ring 18 of the bearing 16.

Figure 2:
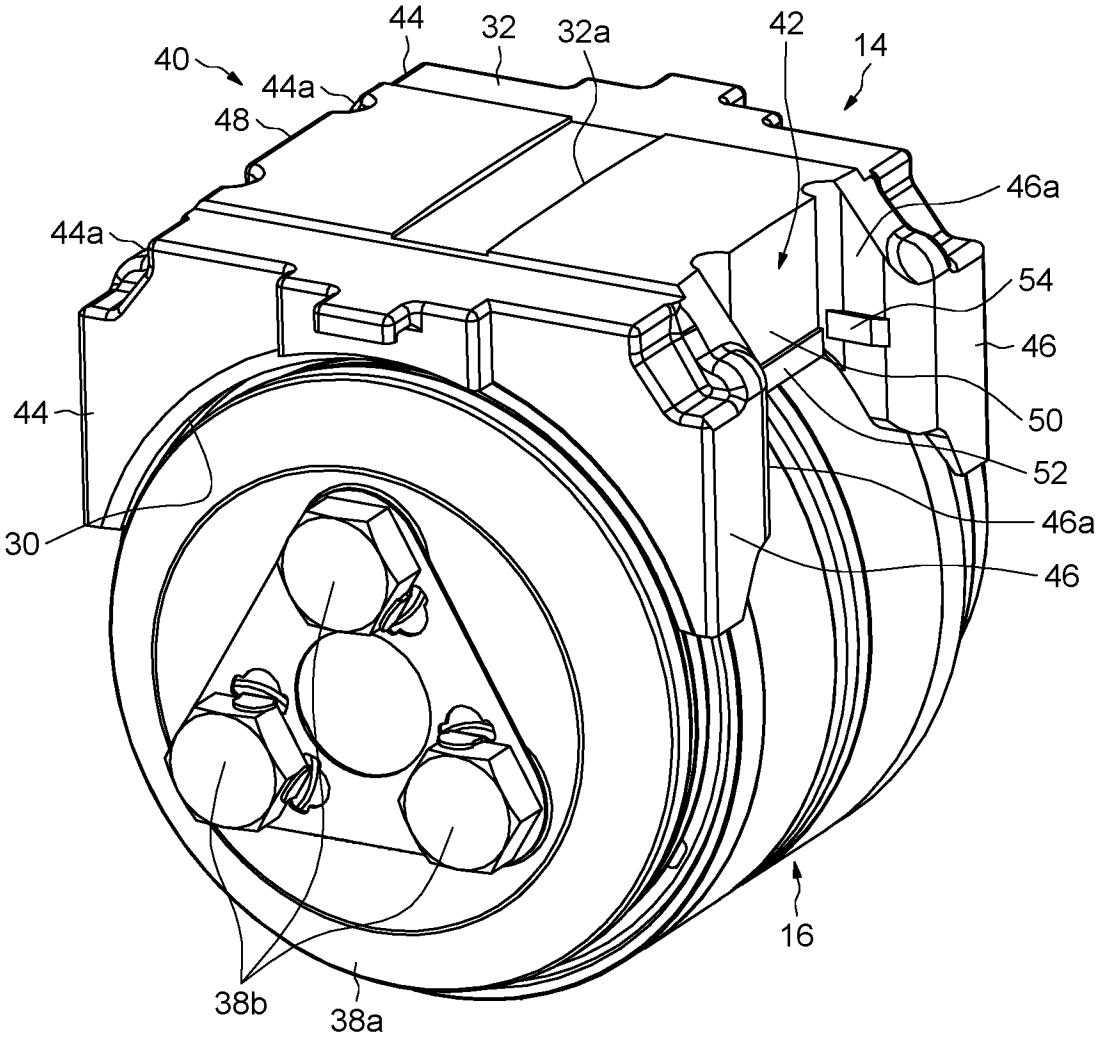
FIGS. 2 and 3 are perspective views of the railcar axle of FIG. 1.
Figure 3:
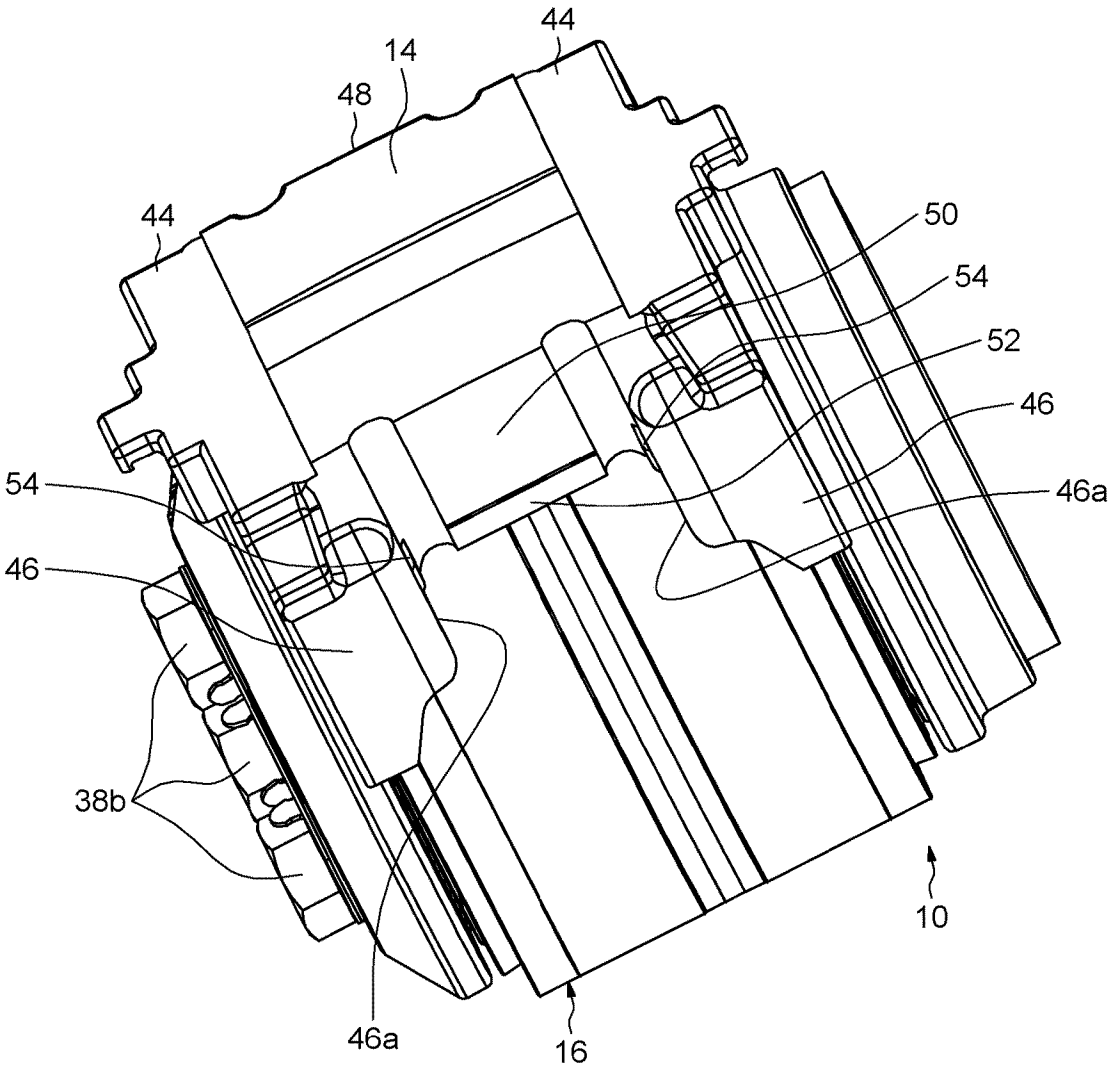

As illustrated in detail on FIGS. 2 and 3, the body of the railcar adapter 14 provides an inner surface 30 in radial contact with the outer ring 20 of the bearing 16 and an outer surface 32 in radial contact with the bogie frame.

The inner surface 30 has a concave shape of constant radius so as to sit on the outer cylindrical surface of the outer ring 20 of the bearing 16.

The outer surface 32 is provided with an upper central groove 32*a* extending along an axis parallel to the axis of rotation X-X of the bearing 16.

The railcar adapter 14 further provides two lateral channels 40, 42 each axially delimited by a pair of opposed lugs 44, 46 and a lateral surface 48, 50 perpendicular to the opposed lugs 44, 46. Each lateral channel 40, 42 has a U-shape and is adapted to engage with a lug of a jaw (not shown) of the bogie frame, so as to act as an insertion guide between the adapter and the bogie frame.

As illustrated, the lateral surface 50 is provided with a first centering bump 52 on the whole length of the lateral surface. As an alternative, the lateral surface 50 may be provided with a plurality of first centering bump or with a first centering bump not covering the whole length of the lateral surface.

The inner lateral surface 46*a* of each lug 46 is provided with second and third centering bumps 54. As illustrated, the second and third centering bumps 54 are provided on the whole length of the corresponding inner lateral surface. As an alternative, the inner lateral surfaces 46*a* may be provided with a plurality of second and third centering bumps or with a second and third centering bump not covering the whole length of the corresponding inner lateral surface.

Furthermore, the perspective views of FIGS. 2 and 3 only shows the centering bumps 52, 54 respectively on one of the lateral surface 42 and both the inner lateral surface of one of the lugs 46. However, it should be easy for the man skilled in the art to imagine all three centering bumps provided respectively on the other lateral surface 48 and on the inner lateral surfaces 44*a* of the other opposed lugs 44.

The centering bumps 52, 54 forms swivelling means allowing the swivelling of the adapter 14 relative to the bogie frame, thus reducing the wear of the adapter in case of twisting of the bogie frame relative to the railcar axle. The connection between the bogie frame and the railcar axle is thus less rigid thanks to such adapter.

As shown on FIGS. 2 and 3, the centering bumps 52, 54 are part of the adapter 14 and are made in the same material as the adapter. As an alternative, the centering bumps 52, 54 may be distinct from the adapter and fixed to the adapter by any suitable way (over moulding, gluing . . . ). Such centering bumps may be made in any material different from the material of the adapter.

As shown on FIGS. 2 and 3, the contact surface of the centering bumps 52, 54 is flat so that the bogie frame is in contact with a small flat surface of the adapter 14. As an alternative, the contact surface of the centering bumps 52, 54 may have other shapes, such as cylindrical or spheroidal.

The railcar adapter 14 is made from metal by any suitable process, such as, for example, by casting or machining. For example, the railcar adapter 14 is made from steel or cast iron.

It should be noted that the embodiments, illustrated and described were given merely by way of non-limiting indicative examples and that modifications and variations are possible within the scope of the invention.

The invention has been illustrated on the basis of a rolling bearing provided with at least one row of rolling elements radially disposed between the inner and outer rings. Alternatively, the bearing may be a plain bearing or a sliding bearing comprising one or two rings.

The invention claimed is:

1. A railcar adapter for connecting a railcar body to a bearing, comprising:

an adapter body having a frame seat side configured to abut the railcar body and having two lateral channels extending perpendicularly from the frame seat side, each of the two lateral channels being axially delimited by a pair of opposed lugs and a lateral surface extending therebetween, each of the two lateral channels being adapted to cooperate with the railcar body, and each of the two lateral channels comprising a first centering bump located on the lateral surface, the first centering bump being spaced from the frame seat side and extending into the lateral channel, the first centering bump being configured to allow swivelling of the railcar adapter relative to the railcar body, wherein each of the two lateral channels has a plurality of the first centering bump located on the lateral surface and extending across an entire length, as measured parallel to the frame seat side, of the lateral surface.

2. The railcar adapter according to claim 1, wherein a contact surface of the first centering bump which abuts the railcar body is a flat surface.

3. The railcar adapter according to claim 1, wherein a contact surface of the first centering bump which abuts the railcar body is a cylindrical surface.

4. The railcar adapter according to claim 1, wherein a contact surface of the first centering bump which abuts the railcar body is a spheroidal surface.

5. The railcar adapter according to claim 1, wherein the first centering bump is part of the adapter.

6. The railcar adapter according to claim 1, wherein the first centering bump is a separate component from the adapter and is affixed thereto.

7. The railcar adapter according to claim 6, wherein the first centering bump is made of a material different from a material of the adapter.

8. The railcar adapter according to claim 1, wherein the railcar adapter is made from any one of steel and cast iron.

9. A railcar adapter assembly comprising:

the railcar adapter of claim 1, a bearing mounted inside the railcar adapter, a backing ring adapted to come into axial contact with the bearing at a first side, and an end cap assembly adapted to come into axial contact with the bearing at another side, opposite to the first side.

10. The railcar adapter assembly according to claim 9, wherein the bearing comprises at least one inner ring and at least one outer ring mounted in radial contact with the inner surface of the railcar adapter.

11. The railcar adapter assembly according to claim 10, wherein the bearing comprises at least one row of rolling elements, arranged between raceways provided on the inner and outer rings.

12. The railcar adapter assembly according to claim 10, wherein the inner ring of the bearing is made in two parts, axially separated by an axial spacer.

13. A railcar adapter assembly, comprising:

the railcar adapter of claim 1, a bearing mounted inside the railcar adapter, a backing ring adapted to come into axial contact with the bearing at a first side, an end cap assembly adapted to come into axial contact with the bearing at another side, opposite to the first side, and a shaft rotatably mounted about an axis of rotation (X-X) relative to a railcar adapter, inside the bearing, the shaft including a first end mounted radially inside the backing ring and a second end, opposite to the first end, secured to the end cap assembly.

* * * * *